US012221786B2

(12) United States Patent
Wu et al.

(10) Patent No.: US 12,221,786 B2
(45) Date of Patent: Feb. 11, 2025

(54) STIRRUP MODULE FOR BEAM REINFORCEMENT SYSTEM AND MANUFACTURING METHOD OF BEAM REINFORCEMENT SYSTEM

(71) Applicant: CHIEN KUO CONSTRUCTION CO., LTD., Taipei (TW)

(72) Inventors: Chang-Shiou Wu, Taipei (TW); Sheng-Yi Yen, Taipei (TW); Chia-Hsuan Huang, Taipei (TW)

(73) Assignee: CHIEN KUO CONSTRUCTION CO., LTD., Taipei (TW)

( * ) Notice: Subject to any disclaimer, the term of this patent is extended or adjusted under 35 U.S.C. 154(b) by 211 days.

(21) Appl. No.: 17/964,315

(22) Filed: Oct. 12, 2022

(65) Prior Publication Data

US 2023/0110083 A1 Apr. 13, 2023

(30) Foreign Application Priority Data

Oct. 12, 2021 (TW) ..... 110137845

(51) Int. Cl.
*E04C 5/00* (2006.01)
*E04C 5/06* (2006.01)

(52) U.S. Cl.
CPC ..... *E04C 5/0622* (2013.01)

(58) Field of Classification Search
CPC ..... E04C 5/00; E04C 5/0622; E04C 5/0645; E04B 1/20; E04B 1/21; E04B 1/5818
See application file for complete search history.

(56) References Cited

U.S. PATENT DOCUMENTS

| | | | | |
|---|---|---|---|---|
| 3,245,190 | A * | 4/1966 | Reiland | E04C 3/34 52/649.3 |
| 3,744,207 | A * | 7/1973 | Oroschakoff | B21F 27/121 52/649.3 |
| 5,392,580 | A * | 2/1995 | Baumann | E04C 5/04 52/646 |
| 6,293,071 | B1 * | 9/2001 | Konstantinidis | E04C 5/0609 52/659 |
| 9,267,287 | B1 * | 2/2016 | Bongiorno | E04C 5/0604 |
| 10,024,047 | B2 * | 7/2018 | Zavitz | E04B 1/215 |
| 10,619,342 | B2 * | 4/2020 | Zavitz | E04B 1/5837 |
| 10,808,393 | B2 * | 10/2020 | Yin | E04B 1/164 |
| 11,060,287 | B2 * | 7/2021 | Verhey | E04C 3/34 |
| 11,466,444 | B2 * | 10/2022 | Zavitz | E04B 1/21 |

(Continued)

*Primary Examiner* — Chi Q Nguyen

(74) *Attorney, Agent, or Firm* — MUNCY, GEISSLER, OLDS & LOWE, P.C.

(57) ABSTRACT

A stirrup module includes an outer stirrup set, an upper-opening stirrup set having an upper opening and provided in an opening of the outer stirrup of the outer stirrup set, and a lower-opening stirrup set having a lower opening and provided in the opening of the outer stirrup of the outer stirrup set. Wherein the upper opening and the opening of the outer stirrup are oriented in the same direction, the lower opening and the upper opening are in opposite directions to each other. Wherein the upper-opening stirrup set has a first bottom of stirrup opposite to the upper opening, and the first bottom of stirrup corresponds to the position of the lower opening; the lower-opening stirrup set has a second bottom rib opposite to the lower opening, and the second bottom rib corresponds to the position of the upper opening.

15 Claims, 13 Drawing Sheets

(56) References Cited

U.S. PATENT DOCUMENTS

| | | | | |
|---|---|---|---|---|
| 11,525,263 | B2 * | 12/2022 | Chiang | E04C 5/166 |
| 11,753,824 | B2 * | 9/2023 | Yin | E04C 5/0622<br>52/649.3 |
| 2012/0090262 | A1 * | 4/2012 | Scola | E04C 5/064<br>52/745.21 |

* cited by examiner

STIRRUP MODULE FOR BEAM REINFORCEMENT SYSTEM AND MANUFACTURING METHOD OF BEAM REINFORCEMENT SYSTEM

BACKGROUND OF THE INVENTION

1. Field of the Invention

The present invention related to a stirrup module; specifically related to a stirrup module for beam reinforcement system and manufacturing method thereof.

2. Description of the Prior Art

Structures using reinforced concrete (RC) are often used in the construction engineering. Conventional beam reinforcement system in the reinforced concrete structures mainly includes a plurality of main bars arranged in parallel and a plurality of stirrups for bundling the main bars. The stirrups are mainly tightened and positioned on the main bars, and compose reinforced main structures in the reinforced concrete structures. Then formworks are manufactured around the reinforced structure, concrete grouting is processed hereafter to form the reinforced concrete structure.

In recent years, a hooping stirrup structure has been developed, which is provided on the surface across the main bar, so that hooping force can be distributed evenly across the cross section of the beam. However, it is not convenient to add more main bars after the stirrups have been disposed and it takes longer time to do so. Therefore, it is essential to solve problems in the current arts so as to enhance convenience of construction and shorten its engineering time.

SUMMARY OF THE INVENTION

The present invention intends to provide a stirrup module for beam reinforcement system, used for enhancing convenience of construction and shortening the construction time of beam reinforcement systems.

The stirrup module of the present invention includes an outer stirrup set having an outer stirrup opening, an upper-opening stirrup module provided in the outer stirrup set and having an upper opening, and a lower opening overlapped with the upper-opening stirrup module each other and having a lower opening. Wherein the upper opening and the outer stirrup opening are oriented in a same direction, and wherein the lower opening and the upper opening are oriented in opposite directions each other. In addition, the upper stirrup module has a first bottom rib opposite to the upper opening, the location of the first bottom rib and the lower opening of the lower stirrup module are corresponded to each other; the lower-opening stirrup module has a second bottom rib opposite to the lower opening, and the location of the second bottom rib and the upper opening of the upper stirrup module are corresponded to each other.

The aforementioned stirrup modules are used for the manufacturing method of the beam reinforcement system of the present invention, and the method comprises steps of: providing two first main bars in parallel; hanging the plurality of the outer stirrup modules on the two first main bars one by one; providing the plurality of upper-opening stirrup modules on a plurality of outer stirrup sets; providing a plurality of second main bars on a bottom portion of the plurality of stirrup modules via the outer stirrup opening; providing a plurality of third main bars on a top portion of the plurality of stirrup modules, wherein the first main bars and the third main bars are arranged in parallel; providing the plurality of lower stirrup modules on the plurality of third main bars, wherein it is hooked on the plurality of third main bars via a hang portion of the lower opening stirrup transversely; and providing a plurality of stirrup caps on the plurality of stirrup modules, wherein the stirrup caps are provided corresponding to the openings.

By using the stirrup module of the present invention, assembling the main bars is more convenient so as to shorten the engineering time of the stirrup module.

DETAILED DESCRIPTION OF THE PREFERRED EMBODIMENT

In order to make people skilled in the art further understand the purposes, the structures, and the effects of the present invention, the present invention will be described in detail using preferred embodiments with reference to drawings.

Figure 1:
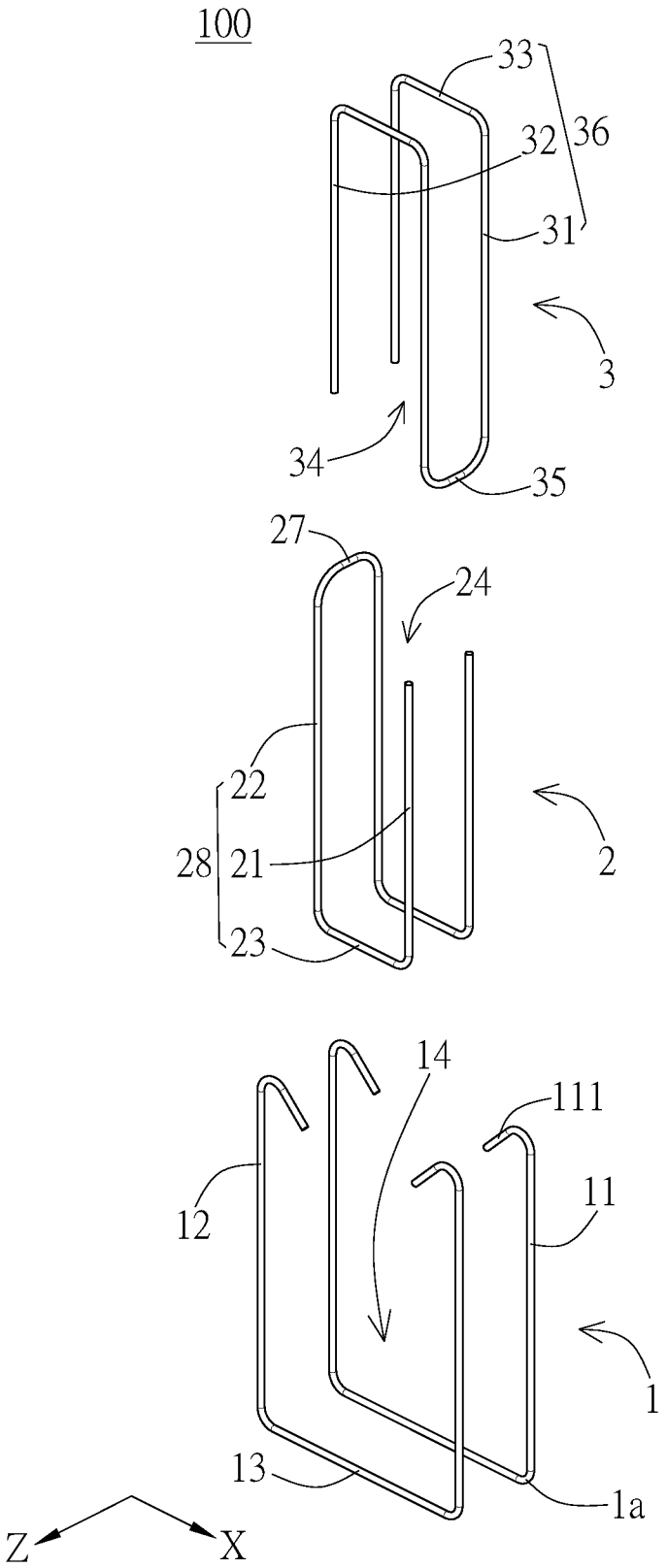
FIG. 1 is an exploded view of an embodiment of the stirrup module of the present invention.
Figure 2:
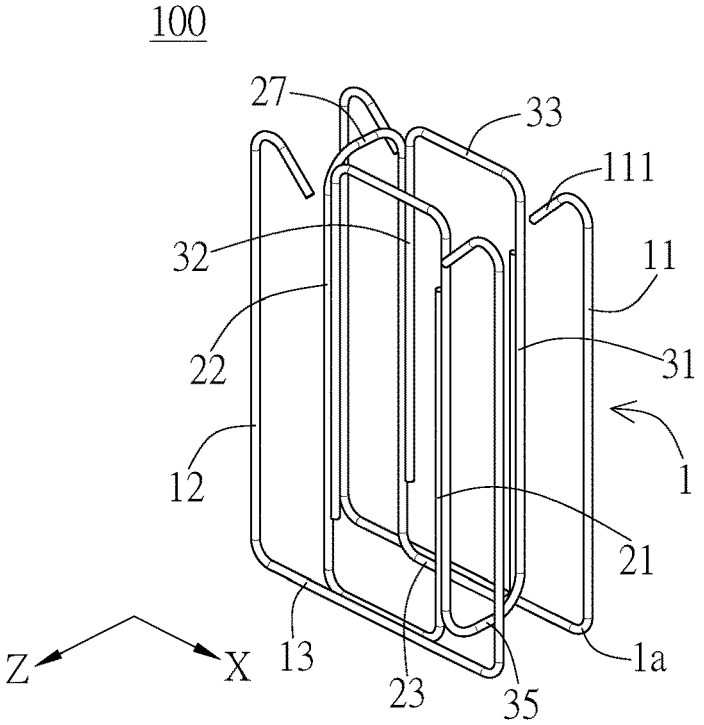
FIG. 2 is a perspective view of an embodiment of the stirrup module of the present invention.
Figure 3:
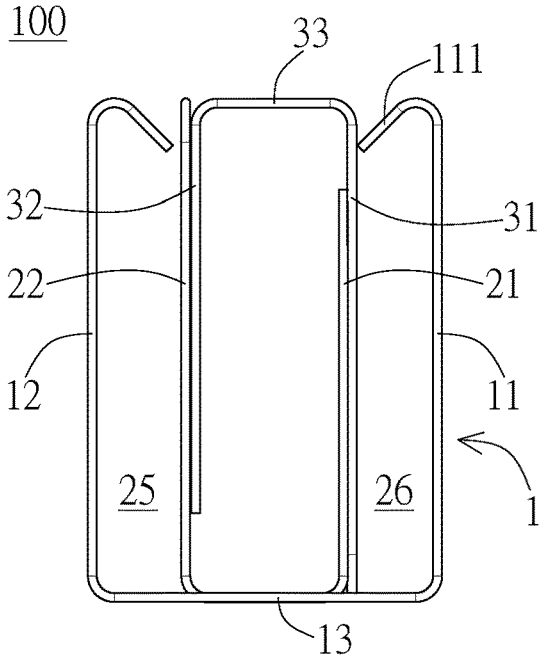
FIG. 3 is a side view of of an embodiment of the stirrup module of the present invention.

The present invention provides a stirrup module for beam reinforcement system and a manufacturing method thereof. Firstly, FIG. 1 to FIG. 3 illustrates a preferred embodiment of the structure of the stirrup module. The stirrup module 100 of the present invention includes an outer stirrup set 1, an upper-opening stirrup module 2, and a lower-opening stirrup module 3. The outer stirrup set 1 includes two stirrups 1*a*, wherein each of the stirrup 1*a* includes a first outer erect bar portion 11, a second outer erect bar portion 12, and a bottom rib section 13. The first outer erect bar portion 11 and the second outer erect bar portion 12 are arranged in parallel along a first direction X. The bottom rib section 13 extends along the first direction X and is provided at bottom ends of the first outer erect bar portion 11 and the second outer erect bar portion 12; that is, two ends of the bottom rib section 13 are respectively connected to the bottom ends of the first outer erect bar portion 11 and the second outer erect bar portion 12. In addition, an outer stirrup opening 14 is formed at an end opposite to the bottom rib section 13, so that the outer stirrup set 1 has the outer stirrup opening 14, and at least one main bar is provided or received via the outer stirrup opening 14. The first outer erect bar portion 11 has a hook end 111; the second outer erect bar portion 12 has a hook end 111, so that the hook ends 111 can be hooked on the main bars of the beam reinforcement system. In the embodiment of the present invention, an appearance of the hook end 111 illustrated in FIG. 1 is designed to be hooked on the main bars of the beam reinforcement stably; however, the appearance of the hook end 111 is not limited thereto. The aforementioned erect bar portions, the bottom rib section 13 and the connections therebetween are preferably integrally formed by bending single piece of steel bar, but not limited thereto.

The upper-opening stirrup module 2 includes two first inner erect bar portions 21, two second inner erect bar portions 22, and two first bottom ribs 23. The first inner erect bar portions 21 are respectively arranged in parallel with the second outer erect bar portion 12, and located between the first outer erect bar portion 11 and the second outer erect bar portion 12. Specifically, the first inner erect bar portions 21 are respectively arranged in parallel with the second outer erect bar portion 12, so that the two first inner erect bar portions 21 are arranged in parallel along a second direction Z. The second inner erect bar portions 22 are respectively arranged in parallel with the first outer erect bar portion 11, and located between the second outer erect bar portion 12 and the first outer erect bar portion 11. As illustrated in FIG. 2, between the second outer erect bar portion 12 and the first outer erect bar portion 11, the first inner erect bar portions 21 are respectively arranged in parallel with the second outer erect bar portions 12, and the second inner erect bar portions 22 are respectively arranged in parallel with the first outer erect bar portions 11.

The first bottom ribs 23 are respectively arranged in parallel with the bottom rib section 13 of an outer stirrup 1*a*. Wherein the first bottom ribs 23 are provided on bottom ends of the first inner erect bar portions 21 and the second inner erect bar portions 22 along the first direction X and form an upper opening 24. The upper opening 24 and the outer stirrup opening 14 are oriented in a same direction, so that the upper-opening stirrup module 2 can be provided in the outer stirrup set 1. On the other hand, the first inner erect bar portions 21, the first bottom rib 23, the second inner erect bar portions 22 are configured to form an accommodating portion 28. Specifically, the accommodating portion 28 extends from the first inner erect bar portions 21 to the bottom end thereof. Then the bottom end of the first inner erect bar portions 21 is bended relative to the first bottom rib 23 and extends along the first direction X to be connected to the bottom end of the second inner erect bar portions 22. Finally, it extends from the bottom end of the second inner erect bar portions 22 to the space formed by the second inner erect bar portions 22, and it can accommodate at least one main bar. A first gap 25 is formed between the second outer erect bar portion 12 and the second inner erect bar portion 22; a second gap 26 is formed between the first outer erect bar portion 11 and the first inner erect bar portions 21; and wherein the first gap 25 and the second gap 26 are respectively formed with an opening at an end opposite to the bottom rib section 13 of the outer stirrup 1*a*.

The upper-opening stirrup module 2 of the embodiment further includes a connection top rib 27. The connection top rib 27 is configured to connect top ends of the two second inner erect bar portions 22 along the second direction Z to form a fixed portion. Each of the aforementioned erect bar portions, top ribs, and bottom ribs, and connection relationships thereof are preferably integrally formed by bending single piece of steel bar, but not limited thereto.

The lower-opening stirrup module 3 includes two third erect bar portions 31, two fourth inner erect bar portions 32, and two second bottom ribs 33. the third inner erect bar portions 31 are respectively arranged in parallel with the first outer erect bar portion 11, and located between the first outer erect bar portion 11 and the second outer erect bar portion 12. Specifically, the third inner erect bar portions 31 are respectively arranged in parallel with the first outer erect bar portion 11, so that the two third inner erect bar portions 31 are arranged in parallel along the second direction Z. The fourth inner erect bar portions 32 are respectively arranged in parallel with the second outer erect bar portion 12, and located between the third inner erect bar portions 31 and the second outer erect bar portion 12. Specifically, as illustrated in FIG. 2, between the second outer erect bar portion 12 and the first outer erect bar portion 11, the second inner erect bar portions 22 are respectively arranged in parallel with the second outer erect bar portions 12; the fourth inner erect bar portions 32 are respectively arranged to be overlapped with the second inner erect bar portions 22; the third inner erect bar portions 31 are respectively arranged to be overlapped with the first inner erect bar portions 21; and the two first inner erect bar portions 21 are respectively arranged in parallel with the first outer erect bar portion 11.

The second bottom ribs 33 are respectively arranged in parallel with the bottom rib section 13 of the outer stirrup 1*a*. Wherein the second bottom ribs 33 are provided on top ends of the third inner erect bar portions 31 and the fourth inner erect bar portions 32 along the first direction X to form a lower opening 34. The lower opening 34 and the upper opening 24 are oriented in opposite directions, so that the upper-opening stirrup module 2 and the lower-opening stirrup module 3 are provided to be overlapped with each other. Wherein the locations of the second bottom ribs 33 correspond to the first bottom rib 23 and the lower opening 34. The location of the first bottom rib 23 correspond to the second bottom ribs 33 and the upper opening 24. On the other hand, the fourth inner erect bar portions 32, the second bottom ribs 33, and the third inner erect bar portions 31 are configured to form a hang portion 36. Specifically, the hang portion 36 extends from the fourth inner erect bar portions 32 to the top end thereof. Then, the bottom ends of the fourth inner erect bar portions 32 is bended relative to the second bottom ribs 33 and extends along the first direction X to be connected to the top ends of the third inner erect bar portions 31. Finally, it extends from the top ends of the third inner erect bar portions 31 to the space formed by the third inner erect bar portions 31 and it can be configured to hook at least one main bar transversely.

The lower-opening stirrup module 3 of the present invention further includes a linking bottom rib 35. The linking bottom rib 35 is provided on bottom ends of the two third inner erect bar portions 31 along the second direction and forms a connection portion. Each of the aforementioned erect bar portions, top ribs, and bottom ribs, and connection relationships thereof are preferably integrally formed by bending single piece of steel bar, but not limited thereto.

Figure 4:
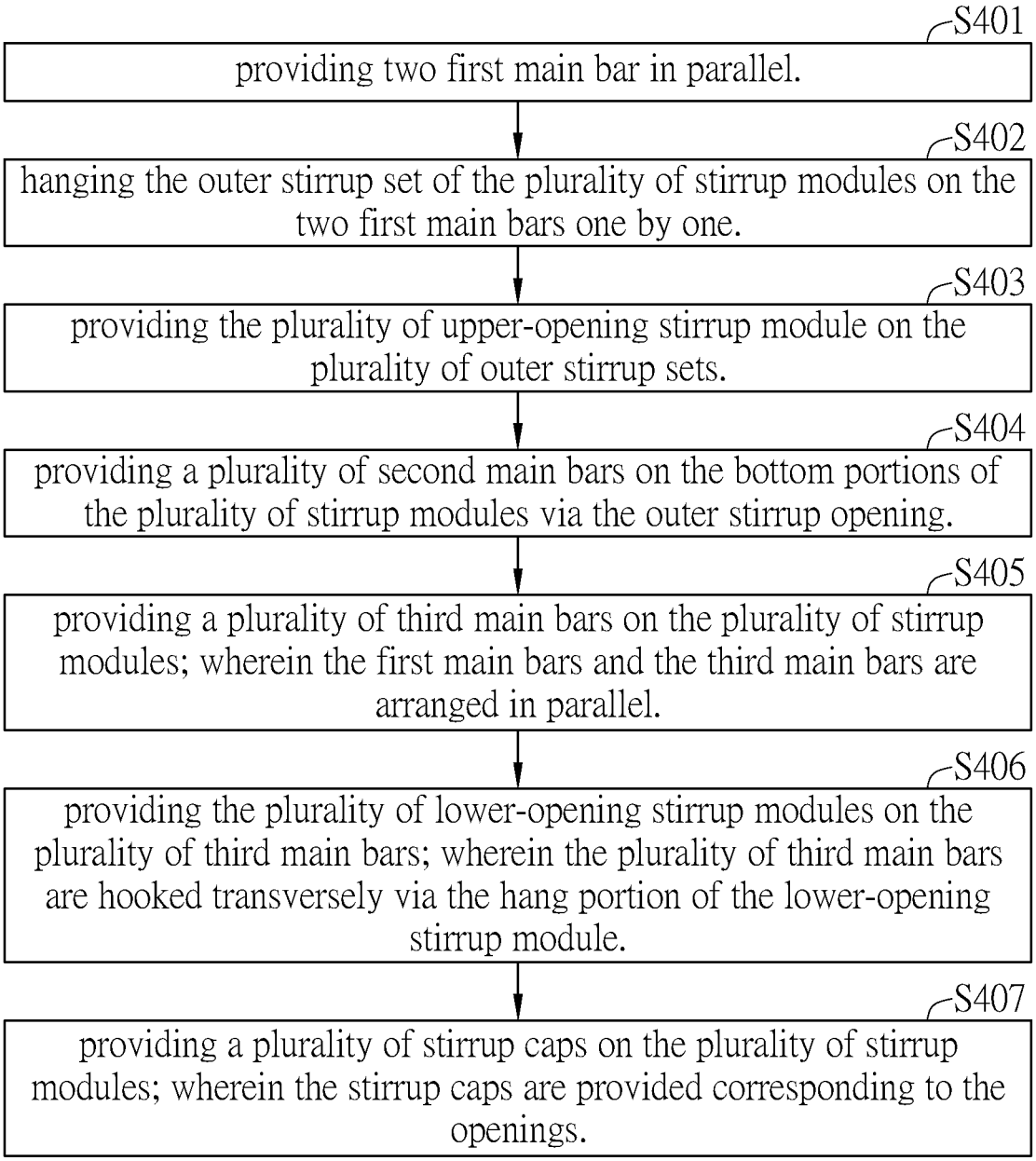
FIG. 4 is a flowchart of main steps of an exemplary manufacturing method of the beam reinforcement system of the present invention.
Figure 5:
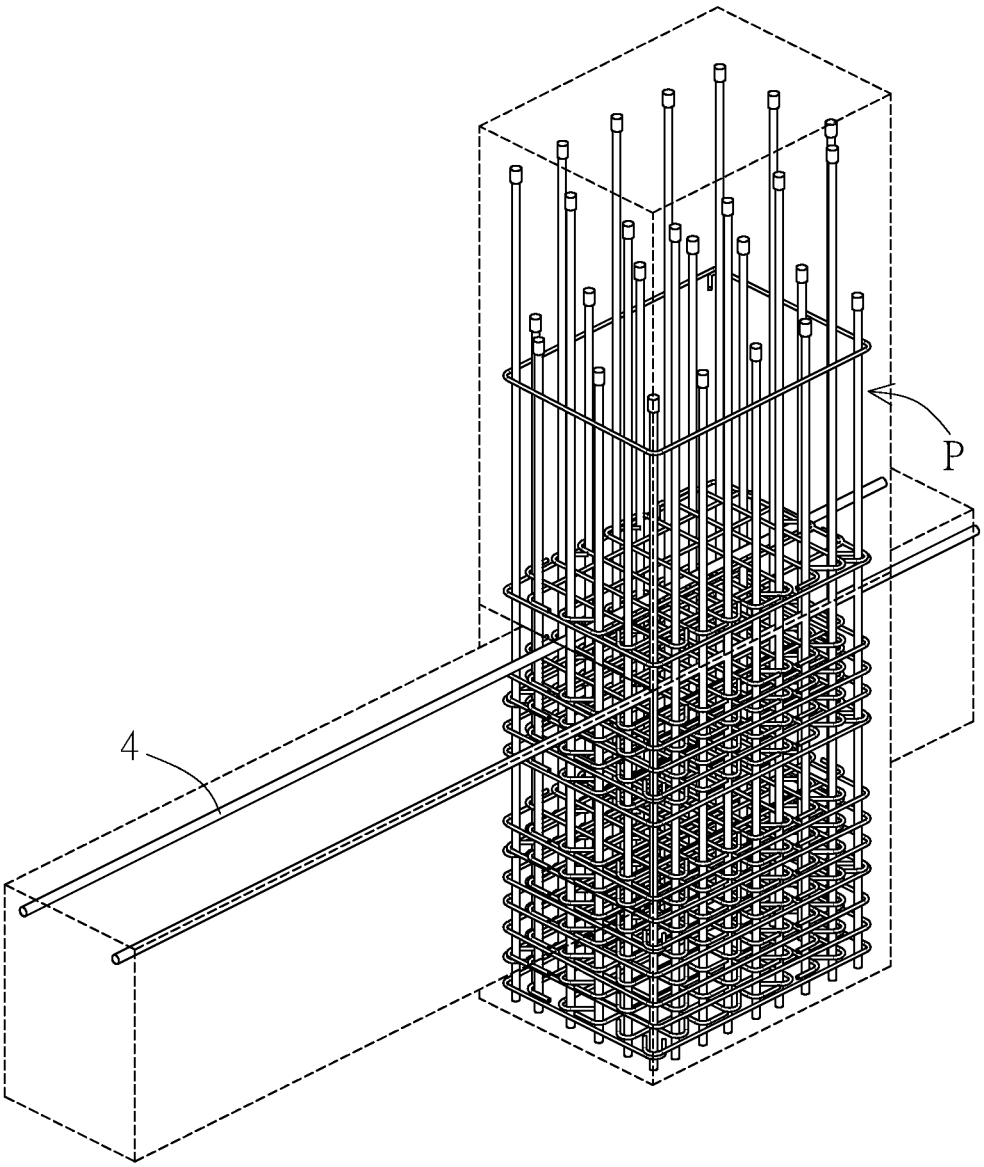
FIG. 5 shows the state of the main step 1 of the exemplary manufacturing method.

FIG. 4 illustrates main steps of an exemplary manufacturing method of the beam reinforcement system of the present invention. The manufacturing method of the present invention starts at step S401: providing two first main bar 4 in parallel. Specifically, as illustrated in FIG. 5, the two first main bars 4 are configured to pass through a vertical reinforcing steel body P, and the two first main bars 4 are paralleled on a same horizontal surface.

Figure 6:
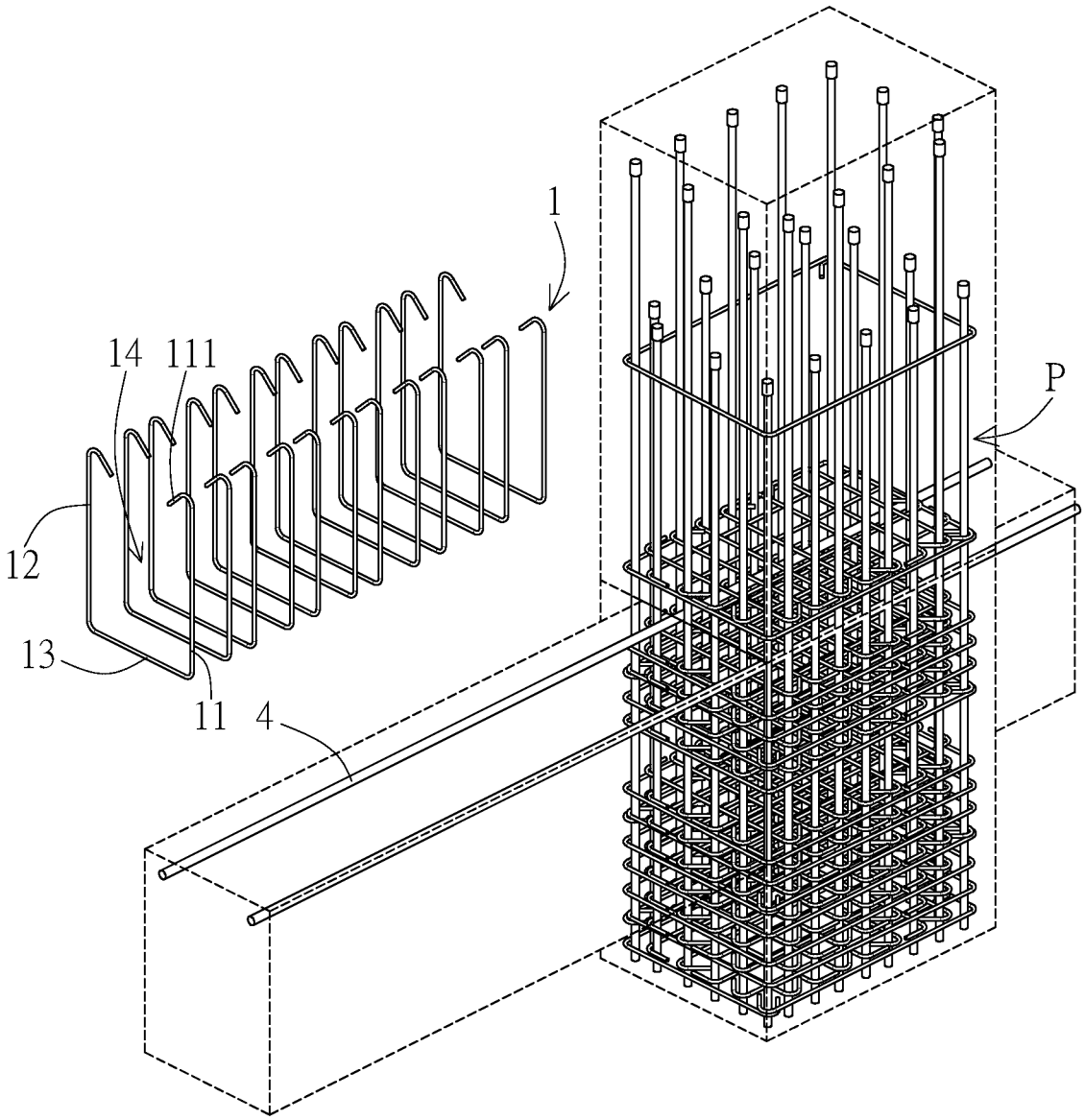
FIG. 6 shows the state of the main step 2 of the exemplary manufacturing method.

The manufacturing method is proceeded to step S402: hanging the outer stirrup set 1 of the plurality of stirrup modules 100 on the two first main bars 4 one by one. Specifically, as illustrated in FIG. 6, the outer stirrup sets 1 of the stirrup modules 100 of the present invention are hooked on the first main bars 4 by the hook ends 111, so that the plurality of outer stirrup sets 1 are hanged on the two first main bars 4.

Figure 7:
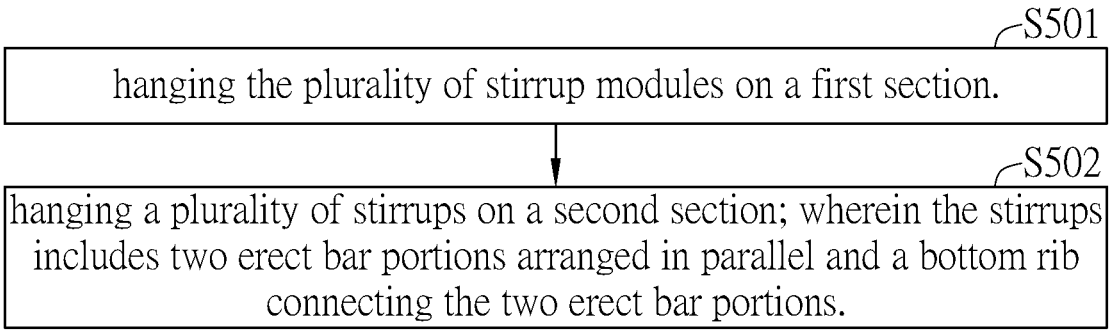
FIG. 7 is a flowchart of detailed steps of the exemplary manufacturing method of the beam reinforcement system.
Figure 8:
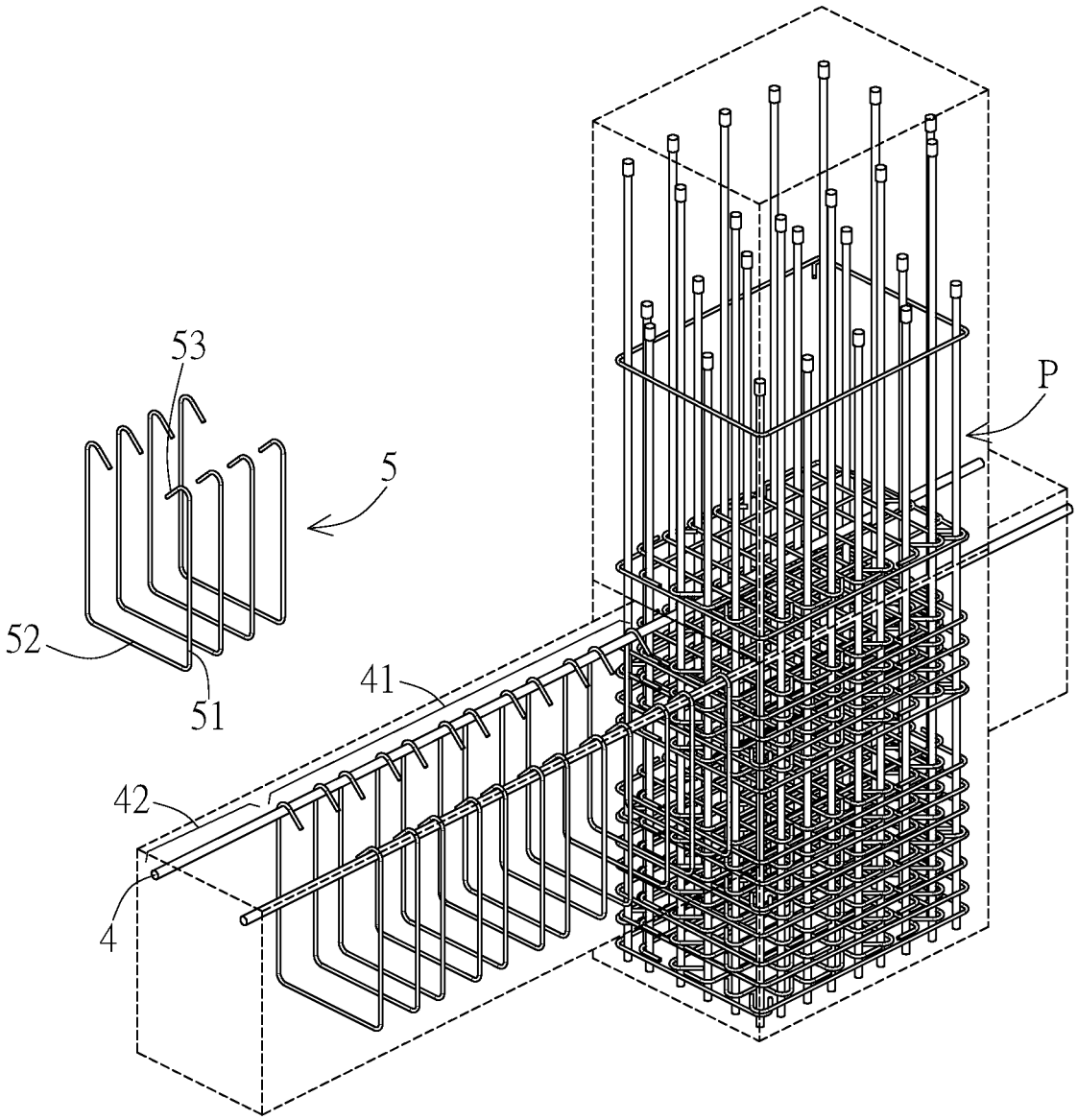
FIG. 8 shows the state of the detailed step of the exemplary manufacturing method.
Figure 9:
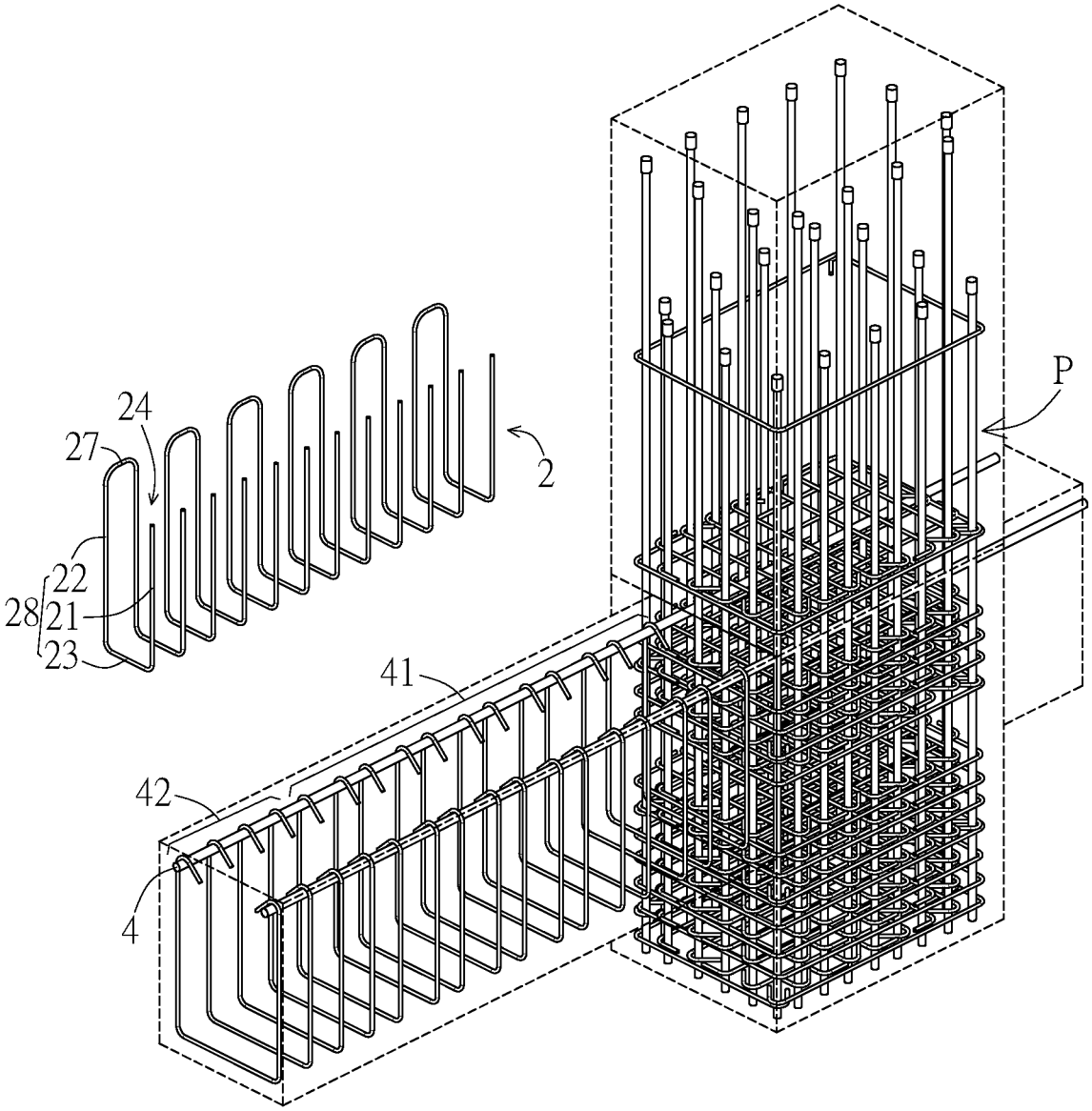
FIG. 9 shows the state of the main step 3 of the exemplary manufacturing method of the present invention.

In addition, the manufacturing method of the beam reinforcement system may further includes detailed steps illustrated in FIG. 7. As further illustrated in FIG. 8, the manufacturing method is proceeded to step S501: hanging the plurality of stirrup modules 100 on a first section 41. Specifically, as illustrated in FIG. 8 and FIG. 9, the outer stirrup set 1 is hanged on the first section 41 of the first main bars 4 in advance, and other elements forming the stirrup modules 100 are hanged in the later steps.

The manufacturing method is proceeded to step S502: hanging a plurality of stirrups 5 on a second section 42. Wherein the stirrups 5 includes two erect bar portions 51 arranged in parallel and a bottom rib 52 connecting the two erect bar portions. Specifically, as illustrated in FIG. 8, the stirrups 5 further includes hook ends 53. The hook ends 53 extend from top ends of the two erect bar portions 51 arranged in parallel. As illustrated in FIG. 9, the stirrups 5 are hanged on the second section 42 of the first main bars 4 by the hook ends 53. The first section 41 and the second section 42 in the present embodiment respectively correspond to a corner formation area and non-corner formation area. In the first section 41, the hooping force of the main bars of the bean reinforcement system of the present invention along a vertical direction can be distributed evenly.

Figure 10:
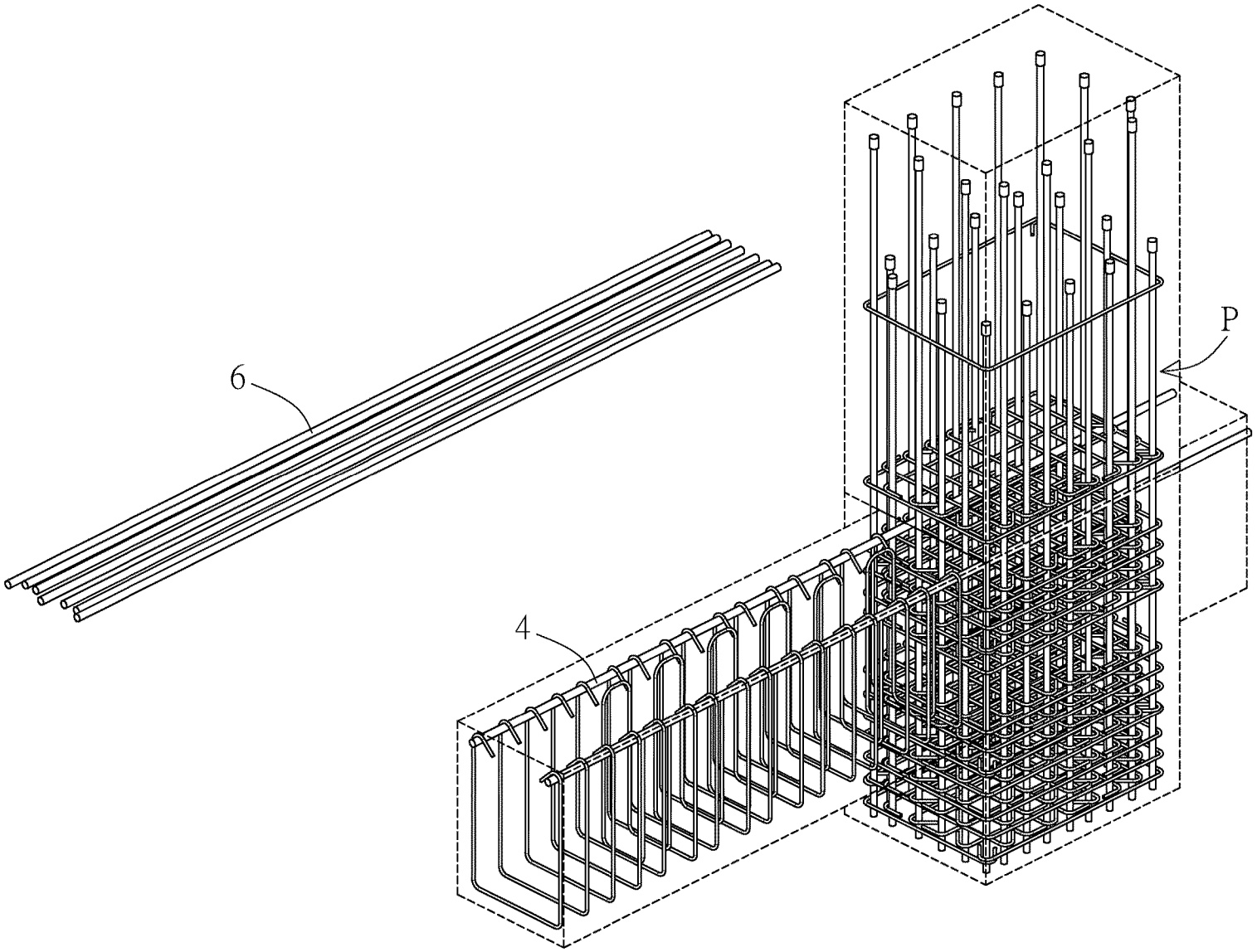
FIG. 10 shows the state of the main step 4 of the exemplary manufacturing method of the present invention.

The manufacturing method is proceeded to a step S403: providing the plurality of upper-opening stirrup module 2 on the plurality of outer stirrup sets 1. Specifically, as illustrated in FIG. 9 and FIG. 10, the first bottom ribs 23 of the plurality of upper-opening stirrup module 2 are respectively provided corresponding to and overlapping with the bottom rib section 13 of one of the outer stirrup sets 1 on a same horizontal surface, so that the first inner erect bar portions 21 are located between the second outer erect bar portions 12 and the second inner erect bar portions 22. The second inner erect bar portions 22 are located between the first inner erect bar portions 21 and the first outer erect bar portions 11. In addition, the plurality of upper-opening stirrup module 2 and the plurality of outer stirrup sets 1 are bonded by fixed members. The fixed members in the embodiment are iron wires; however, materials and appearances of the fixed members are not limited thereto.

Figure 11:
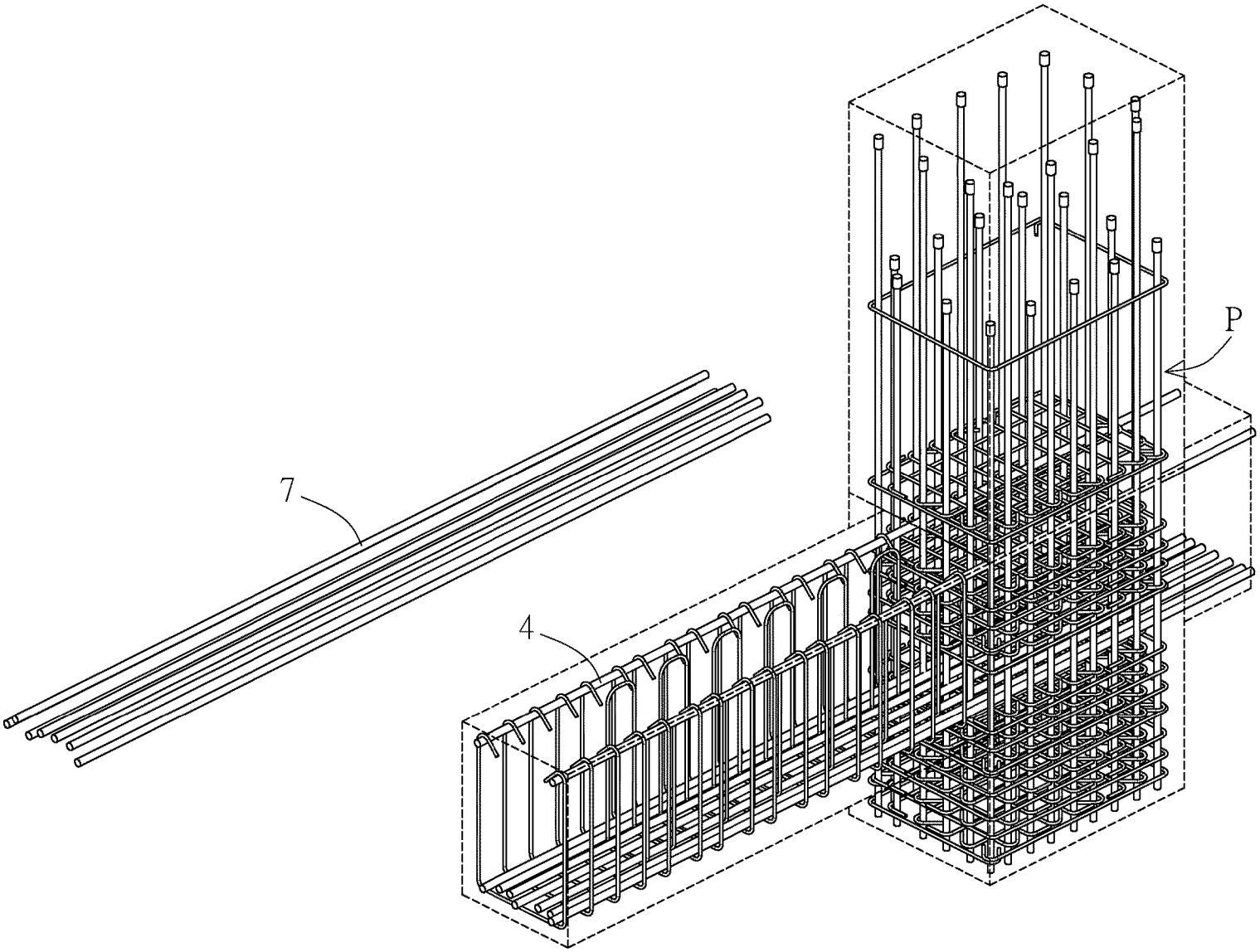
FIG. 11 shows the state of the main step 5 of the exemplary manufacturing method of the present invention.

The manufacturing method is proceeded to a step S404: providing a plurality of second main bars 6 on the bottom portions of the plurality of stirrup modules 100 via the outer stirrup opening 14. Specifically, as illustrated in FIG. 10 and FIG. 11, the second main bars 6 pass through the vertical reinforcing steel body P, enter and received in the bottom rib section 13 of the outer stirrup set 1 and the accommodating portion 28 of the upper-opening stirrup module 2 passing through the outer stirrup opening 14 and the upper opening 24.

Figure 12:
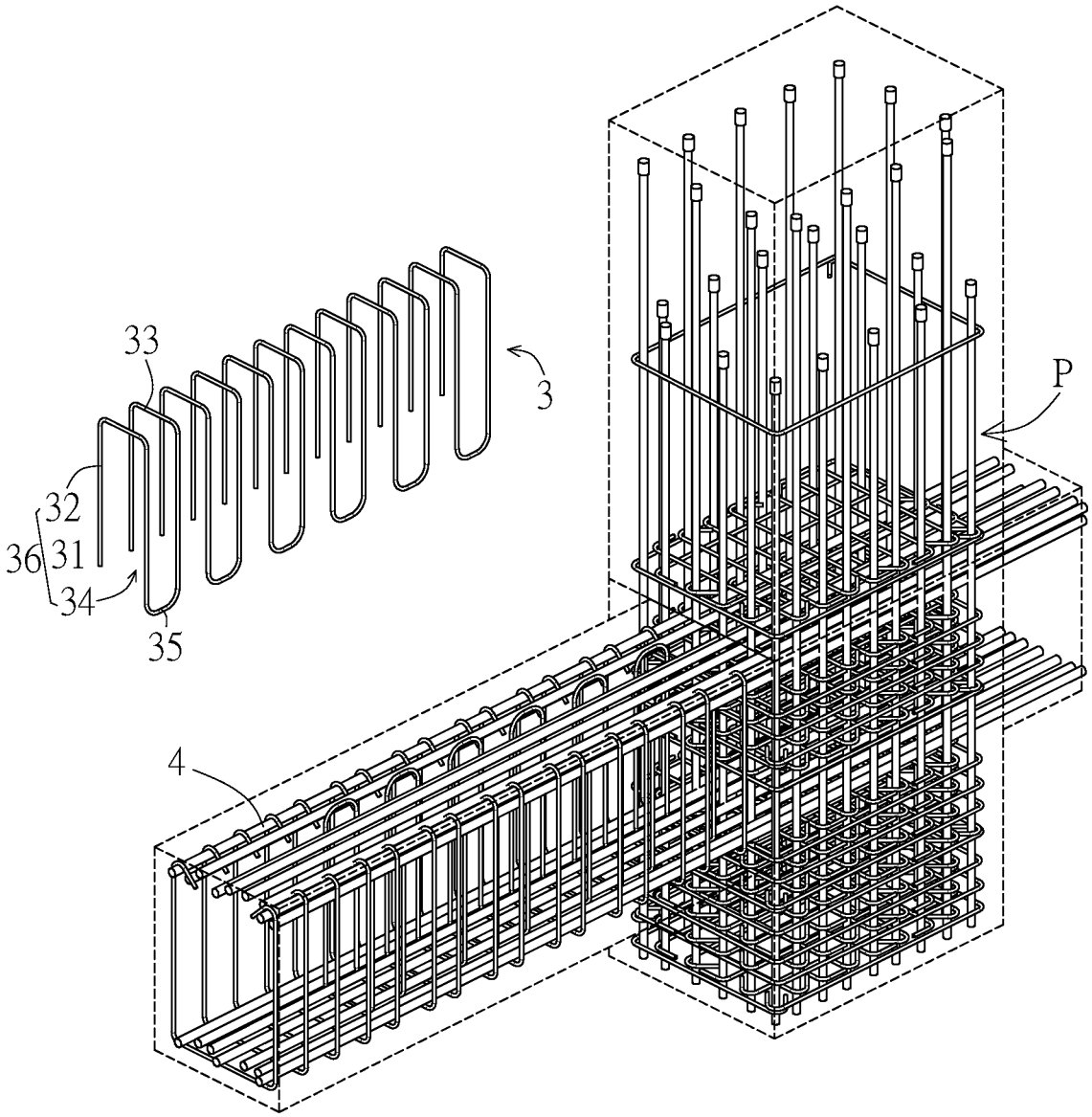
FIG. 12 shows the state of the main step 6 of the exemplary manufacturing method of the present invention.

Then, the manufacturing method is proceeded to step S405: providing a plurality of third main bars 7 on the plurality of stirrup modules 100; wherein the first main bars 4 and the third main bars 7 are arranged in parallel. Specifically, as illustrated in FIG. 11 and FIG. 12, the third main bars 7 pass through the vertical reinforcing steel body P and are bonded by fixed members. So that the third main bars 7 and the first main bars 4 are arranged in parallel on a same horizontal surface.

Figure 13:
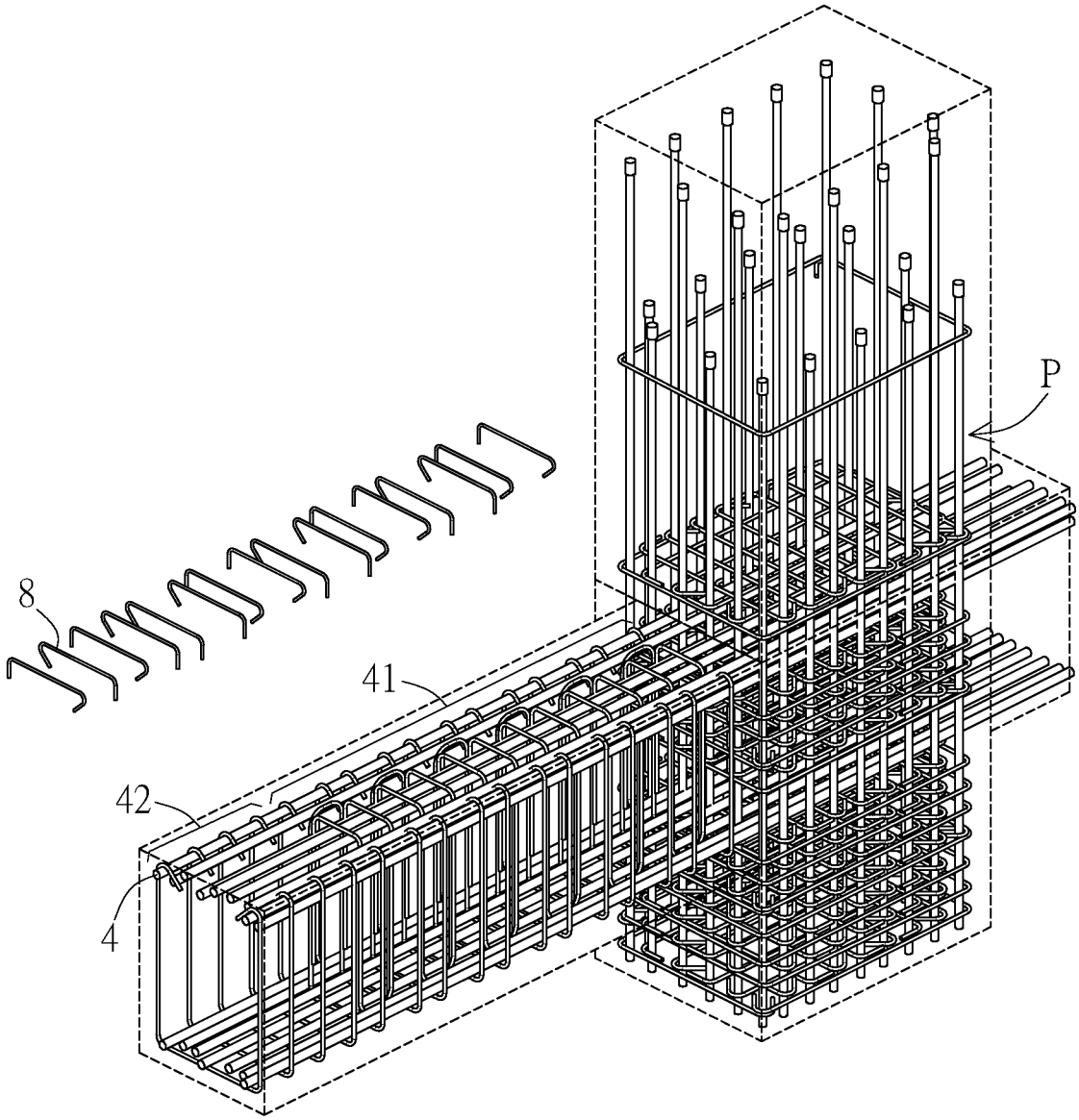
FIG. 13 shows the state of the main step 7 of the exemplary manufacturing method of the present invention.

In addition, the manufacturing method is proceeded to step S406: providing the plurality of lower-opening stirrup modules 3 on the plurality of third main bars 7. Wherein the plurality of third main bars 7 are hooked transversely via the hang portion 36 of the lower-opening stirrup module 3. Specifically, as illustrated in FIG. 12 and FIG. 13, the lower opening 34 of the lower-opening stirrup module and the upper opening 24 of the upper-opening stirrup module 2 are oriented to opposite directions. The lower-opening stirrup module 3 is overlapped with the upper-opening stirrup module 2 each other so as to at least partially extend to the upper-opening stirrup module 2 to together form a closed inner loop stirrup system, so that the hang portion 36 of the lower-opening stirrup module 3 can be hooked on the plurality of third main bars 7 transversely.

Figure 14:
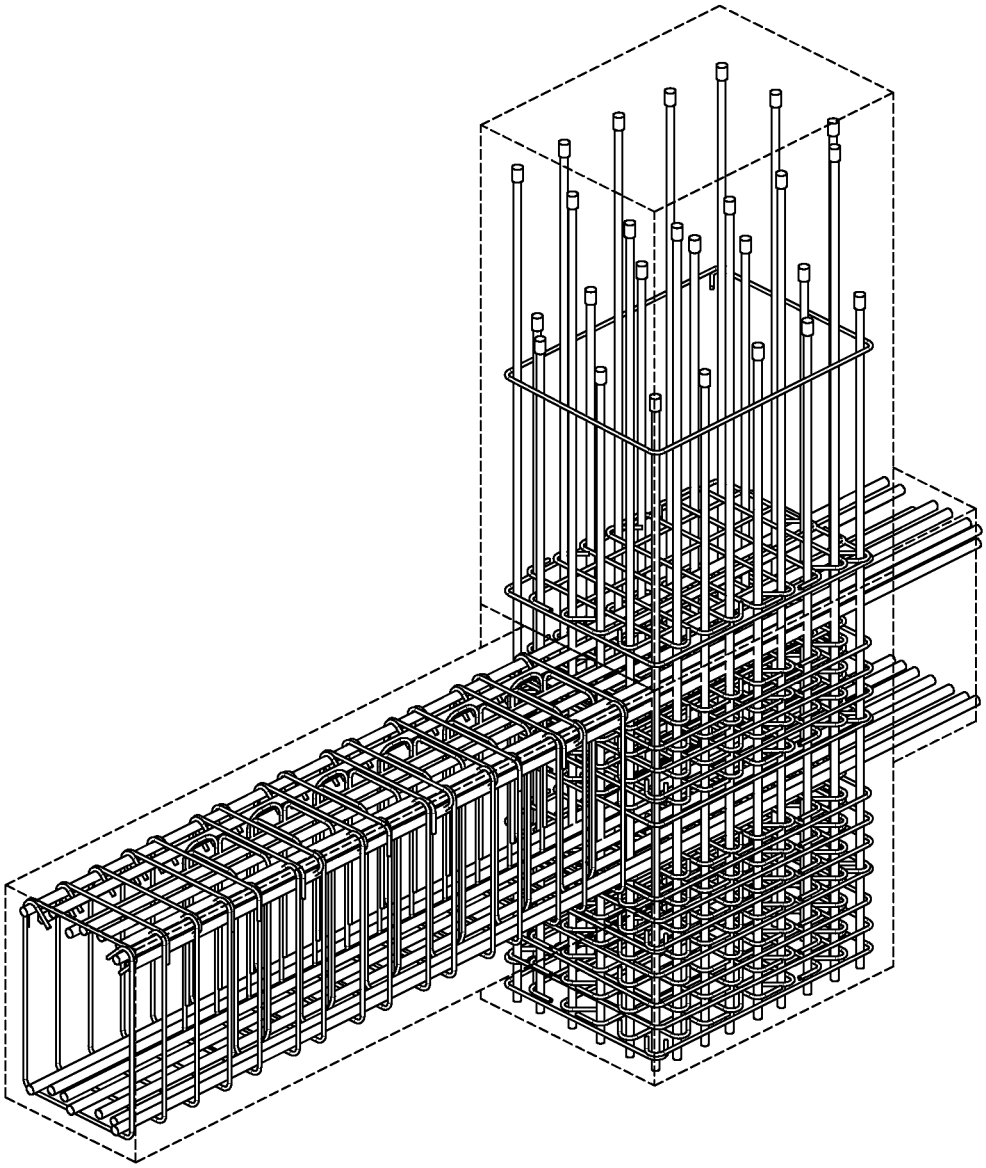
FIG. 14 shows the state of an exemplary completed bean reinforcement system of the present invention.

Finally, the manufacturing method is proceeded to step S407: providing a plurality of stirrup caps 8 on the plurality of stirrup modules 100. Wherein the stirrup caps 8 are provided corresponding to the openings. Specifically, as illustrated in FIG. 13 and FIG. 14, the stirrup caps 8 are provided corresponding to the stirrups 5 located at the second section 42 and the openings of the outer stirrup set 1 located at the first section 41. In the preferred embodiment of the present invention, each of the stirrup caps 8 is hooked on the first main bars 4 beside a hook end 53 of the one of the stirrups 5 so that each of the stirrups 5 has a stirrup cap 8 provided on it and corresponding to the opening of the stirrup 5. One of the stirrup caps 8 is provided beside the hook end 53 located at two ends of each of the outer stirrup 1*a*, so that each of the outer stirrup 1*a* has one of the stirrup caps 8 on it and corresponding to the outer opening of the outer stirrup 1*a*. Finally, FIG. 14 shows the completed beam reinforcement system according to the embodiment of the present invention.

The stirrup module for beam reinforcement system can be hanged on the main bar via the hook end of the outer stirrup module, the outer opening of the outer stirrup module receives the upper-opening stirrup module and the lower-opening stirrup module, and the upper opening of the upper-opening stirrup module and the lower opening of the lower-opening stirrup module are oriented to opposite directions and they can be overlapped with each other. The stirrup module is beneficial for the disposition of the main bars; hence, the engineering time of manufacturing the stirrup module can be shortened.

The aforementioned embodiments of present invention can be modified by people skilled in the art, these modification does not exceed over the scope of the present disclosure disclosed in attached claims. Therefore, equivalent variations and modifications based on the contents of claims and specification of the present invention should belong to the scope of the present invention.

What is claimed is:

1. A stirrup module, comprising:

an outer stirrup set having an outer stirrup opening;

an upper-opening stirrup module provided in the outer stirrup set and having an upper opening; wherein the upper opening and the outer stirrup opening are oriented in a same direction; and a lower-opening stirrup module configured to be overlapped with the upper-opening stirrup module and having a lower opening oriented in an opposite direction as the upper opening oriented;

wherein the upper-opening stirrup module has a first bottom rib opposite to the upper opening and corresponding to a location of the lower opening; and the lower-opening stirrup module has a second bottom rib opposite to the lower opening and corresponding to a location of the upper opening.

2. The stirrup module of claim 1, wherein the outer stirrup set includes two stirrups, wherein one of the stirrups includes:

a first outer erect bar portion;

a second outer erect bar portion, the second outer erect bar portion arranged in parallel with the first outer erect bar portion; and a bottom rib section configured to be connected to bottom ends of the first outer erect bar portion and the second outer erect bar portion, and wherein the outer stirrup opening is formed at an end opposite to the bottom rib section.

3. The stirrup module of claim 2, wherein the first outer erect bar portion has a hook end.

4. The stirrup module of claim 2, wherein the second outer erect bar portion has a hook end.

5. The stirrup module of claim 2, wherein the upper-opening stirrup module includes:

two first inner erect bar portions respectively arranged in parallel with the second outer erect bar portion, and located between the first outer erect bar portion and the second outer erect bar portion; and two second inner erect bar portions respectively arranged in parallel with the first outer erect bar portion and located between the second outer erect bar portion and the first outer erect bar portion;

wherein the first bottom rib is configured to connect bottom ends of the first inner erect bar portions and the second inner erect bar portions and to form the upper opening.

6. The stirrup module of claim 5, further comprising a connection top rib configured to connect top ends of the two second inner erect bar portion and forming a fixed portion.

7. The stirrup module of claim 5, wherein the first inner erect bar portions, the first bottom rib, and the second inner erect bar portions are configured to form an accommodating portion, the accommodating portion is configured to receive at least one main bar.

8. The stirrup module of claim 5, wherein a first gap is between the second outer erect bar portion and the second inner erect bar portions, wherein a second gap is between the first outer erect bar portion and the first inner erect bar portion; and wherein the first gap and the second gap are respectively formed with an opening at one end opposite to the bottom rib section.

9. The stirrup module of claim 5, wherein the lower-opening stirrup module comprises:

two third inner erect bar portions respectively arranged in parallel with the first outer erect bar portion and located between the first outer erect bar portion and the second outer erect bar portion; and two fourth inner erect bar portions respectively arranged in parallel with the second outer erect bar portion and located between the third inner erect bar portions and the second outer erect bar portion;

wherein the second bottom rib is configured to connect top ends of the third inner erect bar portions and the fourth inner erect bar portions and to form the lower opening.

10. The stirrup module of claim 9, further comprising a linking bottom rib configured to connect bottom portions of the two third inner erect bar portion and forming a connection portion.

11. The stirrup module of claim 9, wherein the third inner erect bar portions and the first inner erect bar portions are overlapped with each other; the fourth inner erect bar portions and the second inner erect bar portions are overlapped with each other.

12. The stirrup module of claim 9, wherein the fourth inner erect bar portions, the second bottom rib, and the third inner erect bar portions together form a hang portion, the hang portion is configured to hook at least one main bar.

13. A manufacturing method of a beam reinforcement system, comprising the following steps:

providing two first main bars in parallel;

hanging the outer stirrup sets of the plurality of stirrup modules of claim 1 on the two first main bars one by one;

providing the plurality of upper-opening stirrup module in the plurality of outer stirrup sets;

providing a plurality of second main bars in bottom portions of the plurality of stirrup modules via the outer stirrup opening;

providing a plurality of third main bars in top portions of the plurality of stirrup modules; wherein the first main bars and the third main bars are arranged in parallel;

providing the plurality of lower-opening stirrup modules on the plurality of third main bars; wherein it is hanged on the plurality of third main bars via a hang portion of the lower-opening stirrup module; and providing a plurality of stirrup caps on the plurality of stirrup modules;

wherein stirrup caps are provided corresponding to the openings.

14. The manufacturing method of claim 13, wherein the beam reinforcement system includes a first section and a second section connected with each other.

15. The manufacturing method of claim 14, wherein the step of hanging the outer stirrup sets of the plurality of stirrup modules comprises:

hanging the outer stirrup sets on the first section; and hanging a plurality of stirrups on the second section, wherein the stirrups include two erect bar portions arranged in parallel and a bottom rib connecting bottom ends of the two erect bar portions.

* * * * *